US006118106A

United States Patent [19]

Scott

[11] Patent Number: 6,118,106

[45] Date of Patent: Sep. 12, 2000

[54] APPARATUS FOR CONTROLLING AN ELECTRIC HEATER ENERGIZED FROM A SINGLE VOLTAGE ALTERNATING CURRENT SUPPLY

[75] Inventor: Richard Charles Scott, Stourport, United Kingdom

[73] Assignee: Ceramaspeed Limited, United Kingdom

[21] Appl. No.: 09/138,313

[22] Filed: Aug. 21, 1998

[30] Foreign Application Priority Data

Sep. 24, 1997 [GB] United Kingdom ..... 9720265

[51] Int. Cl.[7] ..... H05B 1/02

[52] U.S. Cl. ..... 219/501; 219/492; 219/412; 219/494; 323/235; 307/41

[58] Field of Search ..... 219/490, 492, 219/494, 497, 499, 501, 505, 449, 411–413; 307/39–41; 323/235, 236, 319

[56] References Cited

U.S. PATENT DOCUMENTS

| | | |
|---|---|---|
| 4,233,498 | 11/1980 | Payne et al. . |
| 4,493,980 | 1/1985 | Payne et al. . |
| 4,829,159 | 5/1989 | Braun et al. . |
| 4,902,877 | 2/1990 | Grasso et al. . |

FOREIGN PATENT DOCUMENTS

| | | |
|---|---|---|
| 0155546 | 9/1985 | European Pat. Off. . |
| 0442139 | 8/1991 | European Pat. Off. . |
| 0804049 | 10/1997 | European Pat. Off. . |
| 0442139 | 8/1991 | Germany . |
| 1235683 | 6/1971 | United Kingdom . |
| 2067857 | 7/1981 | United Kingdom . |
| 2112229 | 7/1983 | United Kingdom . |
| 2312570 | 10/1997 | United Kingdom . |
| 8603929 | 7/1986 | WIPO . |

OTHER PUBLICATIONS

European Search Report Completed Jul. 6, 1999.
Search Report Jan. 27, 1998.

*Primary Examiner*—Mark Paschall
*Attorney, Agent, or Firm*—Ira S. Dorman

[57] ABSTRACT

Apparatus is described for controlling an electric heater incorporating at least one electric heating element (2A, 2B, 2C) and energized from a single voltage alternating current supply (8). The apparatus includes a control knob (15) for manually selecting any one of a predetermined number of power settings for the heater from the voltage supply (8), the power settings varying progressively between a minimum power setting and a maximum power setting. The apparatus further includes a controller (10) adapted and arranged to supply to the electric heater within a predetermined constant time interval in each power setting a first dissipated power level and a second dissipated power level. The first dissipated power level comprises a first selected proportion of half cycles in a predetermined number of half cycles of the voltage supply and the second dissipated power level comprises a second selected proportion of half cycles in a predetermined number of half cycles of the voltage supply. In a plurality of power settings the second selected proportion is different to the first selected proportion. There is no more than one change between the first and second dissipated power levels within the predetermined constant time interval.

21 Claims, 4 Drawing Sheets

| | | | Time on | | |
|---|---|---|---|---|---|
| Control angle | Power % | Time off s % | 1 in 3 s % | 2 in 3 s % | Full s % |
| OFF-20 | 1.95 | 3.77 94.3 | 0.23 5.7 | | |
| 20-40 | 2.54 | 3.70 92.5 | 0.30 7.5 | | |
| 40-60 | 3.30 | 3.60 90.0 | 0.40 10.0 | | |
| 60-80 | 4.29 | 3.49 87.3 | 0.51 12.7 | | |
| 80-100 | 5.58 | 3.33 83.3 | 0.67 16.7 | | |
| 100-120 | 7.25 | 3.13 78.3 | 0.87 21.7 | | |
| 120-140 | 9.43 | 2.87 71.8 | 1.13 28.2 | | |
| 140-160 | 12.3 | 2.52 63.0 | 1.48 37.0 | | |
| 160-180 | 15.9 | 2.09 52.3 | 1.91 47.7 | | |
| 180-200 | 20.7 | 1.52 38.0 | 2.48 62.0 | | |
| 200-220 | 26.9 | 0.77 19.3 | 3.23 80.7 | | |
| 220-240 | 35.0 | | 3.80 95.0 | 0.20 5.0 | |
| 240-260 | 45.5 | | 2.54 63.5 | 1.46 36.5 | |
| 260-280 | 59.2 | | 0.90 22.5 | 3.10 77.5 | |
| 280-300 | 76.9 | | | 2.77 69.3 | 1.23 30.7 |
| 300-OFF | 100 | | | | ∞ |

| | | | Time on | | |
|---|---|---|---|---|---|
| Control angle | Power % | Time off s % | 1 in 3 s % | 2 in 3 s % | Full s % |
| OFF-20 | 1.95 | 3.77 94.3 | 0.23 5.7 | | |
| 20-40 | 2.54 | 3.70 92.5 | 0.30 7.5 | | |
| 40-60 | 3.30 | 3.60 90.0 | 0.40 10.0 | | |
| 60-80 | 4.29 | 3.49 87.3 | 0.51 12.7 | | |
| 80-100 | 5.58 | 3.33 83.3 | 0.67 16.7 | | |
| 100-120 | 7.25 | 3.13 78.3 | 0.87 21.7 | | |
| 120-140 | 9.43 | 2.87 71.8 | 1.13 28.2 | | |
| 140-160 | 12.3 | 2.52 63.0 | 1.48 37.0 | | |
| 160-180 | 15.9 | 2.09 52.3 | 1.91 47.7 | | |
| 180-200 | 20.7 | 1.52 38.0 | 2.48 62.0 | | |
| 200-220 | 26.9 | 0.77 19.3 | 3.23 80.7 | | |
| 220-240 | 35.0 | | 3.80 95.0 | 0.20 5.0 | |
| 240-260 | 45.5 | | 2.54 63.5 | 1.46 36.5 | |
| 260-280 | 59.2 | | 0.90 22.5 | 3.10 77.5 | |
| 280-300 | 76.9 | | | 2.77 69.3 | 1.23 30.7 |
| 300-OFF | 100 | | | | ∞ |

FIG 5

APPARATUS FOR CONTROLLING AN ELECTRIC HEATER ENERGIZED FROM A SINGLE VOLTAGE ALTERNATING CURRENT SUPPLY

This invention concerns apparatus for controlling electric heaters and particularly, but not exclusively, electric heaters for use in cooking appliances such as glass-ceramic smooth top cooking appliances.

DESCRIPTION OF PRIOR ART

Heaters in cooking appliances, such as glass-ceramic cooking appliances, are most generally controlled by well known forms of electromechanical energy regulators. Although such devices are relatively inexpensive, they do have limitations. One frequently cited problem resulting from their use is poor cooking performance at low simmering powers. As a result of their mode of operation it is difficult to achieve satisfactory operation to achieve low power dissipations of less than ten percent of rated power. In the case of heaters having a heating element of typical wire or ribbon form of relatively low temperature coefficient of resistance, this is typically only achieved by cyclically operating heaters such that they have an "on" time of the order of five or six seconds followed by a long "off" time typically of the order of one minute.

This type of switching to achieve low power can be detrimental to cooking processes, resulting in comparatively short periods of concentrated heat, followed by comparatively long periods of cooling. The problem is exacerbated by the use of low mass cooking utensils, such as of aluminum, together with fast-responding heaters and the relatively low thermal mass of glass-ceramic appliances. Similar problems are also encountered with recently proposed contact heater appliances incorporating thin cooking plates of low thermal mass and high thermal conductivity, and sometimes also with sheathed forms of heating elements.

The uneven supply of power from a typical electromechanical energy regulator can be smoothed out to some extent by adopting an arrangement of series/parallel switching of multiple heating elements but the complexity of the heater and its controller is undesirably increased, with only a limited number of power settings available.

One possible solution to the problem would be to consider drastically reducing the cycling time period of the electromechanical energy regulator. This is difficult due to the principle of operation of such a regulator and furthermore the life expectancy of electromechanical switch contacts in the regulator would be unacceptably short as a result of the increased switching rate.

Another problem with the use of short cycle times is that international standards exist which seek to prevent repeated connection and disconnection to and from a mains supply network of electrical loads which draw a significant electric current. Resulting changes in current produce small changes in voltage in the mains network and this results in an annoying flicker of electric lights connected to the same mains supply network.

The international standards which determine permitted cycle times, switching frequencies and associated load powers are incorporated into European Union law under the auspices of the Electro Magnetic Compatibility (E.M.C.) Directive and compliance therewith is therefore mandatory in all European Union countries.

OBJECT OF THE INVENTION

It is an object of the present invention to overcome or minimize the above mentioned problems.

SUMMARY OF THE INVENTION

The present invention provides an apparatus for controlling an electric heater incorporating at least one electric heating element and energized from a single voltage alternating current supply, the apparatus comprising:

means for manually selecting any one of a predetermined number of power settings for the heater from the voltage supply, the power settings varying progressively between a minimum power setting and a maximum power setting;

control means adapted and arranged to supply to the electric heater within a predetermined constant time interval in each power setting a first dissipated power level comprising a first selected proportion of half cycles in a predetermined number of half cycles of the voltage supply and a second dissipated power level comprising a second selected proportion of half cycles in a predetermined number of half cycles of the voltage supply, the second selected proportion being different to the first selected proportion in a plurality of power settings, there being no more than one change between the first and second dissipated power levels within the predetermined constant time interval.

The first and second dissipated power levels may be the same only in the maximum power setting for the heater.

The predetermined number of half cycles of the voltage supply, for the first and second selected proportions of half cycles, may be three and the first and second selected proportions of half cycles in the predetermined number of half cycles may be selected from 0/3, 1/3, 2/3 and 3/3.

The heater may have a full or rated power of 1200 to 3000 watts, the at least one heating element exhibiting a maximum change in electrical resistance of the order of 10 percent between room temperature and operating temperature.

For such a heater having only one heating element the predetermined constant time interval may have a minimum value of 0.3 to 12 seconds.

For such a heater having two heating elements arranged for parallel operation, the predetermined constant time interval may have a minimum value of 0.2 to 4 seconds. The two heating elements may have substantially the same electrical resistance value, each element having a full or rated power of 600 to 1500 watts.

For such a heater having three heating elements arranged for parallel operation, the predetermined constant time interval may have a minimum value of 0.1 to 1.5 seconds. The three heating elements may have substantially the same electrical resistance value, each element having a full or rated power of 400 to 1000 watts.

In the case of a heater having a heating element with a full or rated power of 1200 to 3000 watts and comprising a bright radiating component element, for example of tungsten or molybdenum disilicide, exhibiting a large change in electrical resistance between room temperature and operating temperature and connected in series with a ballast component element exhibiting a relatively small maximum change in electrical resistance of the order of 10 percent between room temperature and operating temperature, and in which about one half of the full or rated power is dissipated in the bright radiating component element, the predetermined constant time interval may have a minimum value of 2.5 to 50 seconds.

In the case of a heater having a heating element with a full or rated power of 1200 to 3000 watts and comprising a bright radiating component element, for example of tungsten or molybdenum disilicide, exhibiting a large change in electrical resistance between room temperature and operating temperature and connected in series with a ballast component element exhibiting a relatively small maximum change in electrical resistance of the order of 10 percent between room temperature and operating temperature, and in which about two thirds of the full or rated power is dissipated in the bright radiating component element, the predetermined constant time interval may have a minimum value of 6 to 120 seconds.

The control means may comprise at least one microprocessor-based device and may supply power to the heater by operation of at least one solid state switching device, such as a triac.

When the heater incorporates a plurality of heating elements, each heating element may be supplied with power by operation of a separate solid state switching device.

The means for manually selecting any one of a predetermined number of power settings may comprise an analog potentiometer, or an encoded digital switch, or a touch control system. The potentiometer or encoded digital switch may be of rotary form, operable by a control knob.

The progressive variation of power settings between the minimum power setting and the maximum power setting may follow a geometric progression.

The apparatus of the invention may be applied for control of a heater in a cooking appliance.

By means of the apparatus of the invention, switching cycle times for control of a heater can be reduced, compared with those with an electromechanical energy regulator of the prior art, whilst complying with current international standards and directives with regard to disturbance of mains power supply networks.

The invention is now described by way of example with reference to the accompanying drawings in which:

BRIEF DESCRIPTION OF THE DRAWINGS

FIG. 5 is a table demonstrating operation of the apparatus of the invention at various power settings;

DESCRIPTION OF PREFERRED EMBODIMENTS

Figure 1:
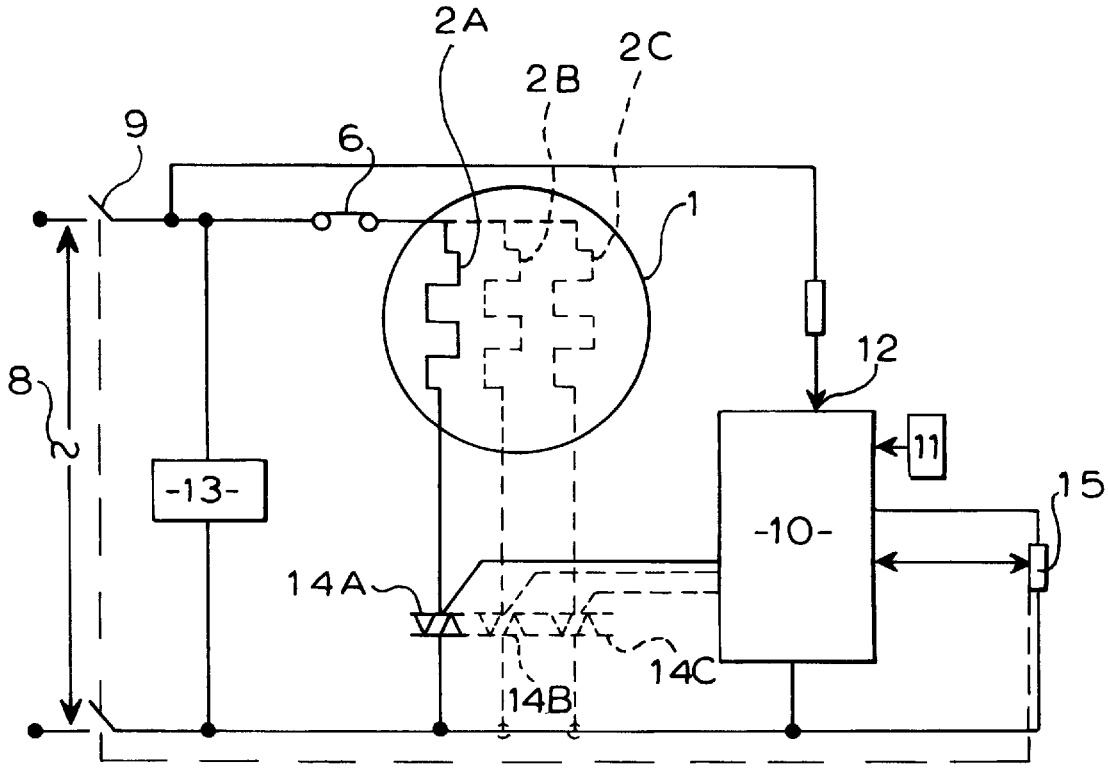
FIG. 1 is a diagrammatic representation of apparatus for controlling an electric heater according to the invention.

Referring to FIG. 1, apparatus is provided for controlling an electric heater 1, which incorporates a single heating element 2A, or two heating elements 2A, 2B arranged for parallel operation, or three heating elements 2A, 2B, 2C, arranged for parallel operations. The or each heating element comprises a metal, or metal alloy, such as iron-chromium-aluminum alloy, such as in wire or ribbon form, or a thick or thin film material deposited on a support, and exhibits a maximum change in electrical resistance of the order of 10 percent between room temperature and the operating temperature.

Figure 2:
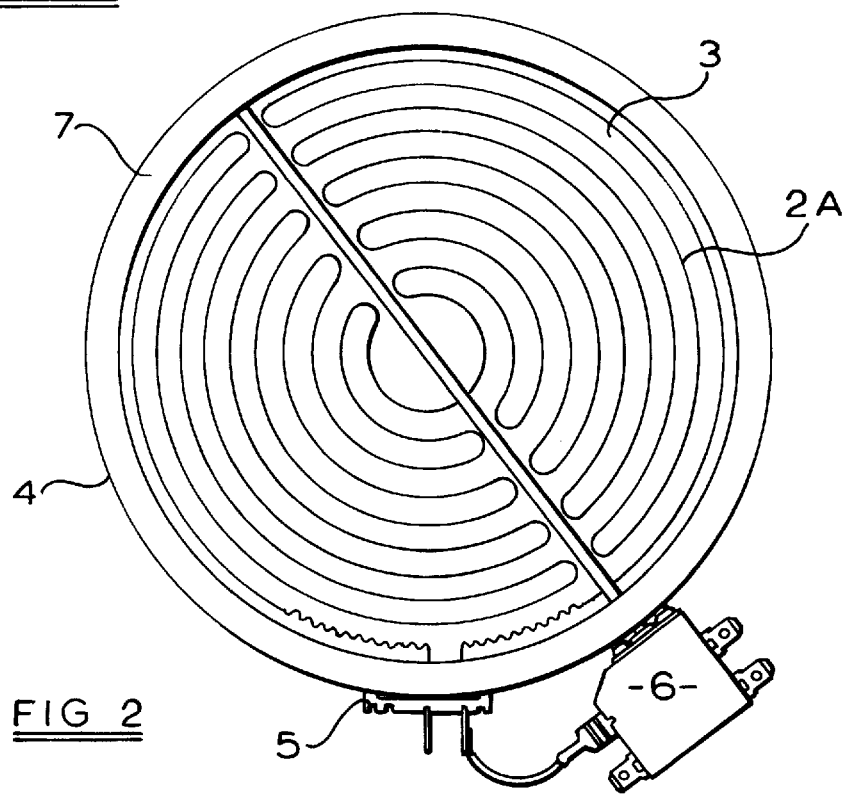
FIG. 2 is a plan view of a heater, having a single heating element, for use with the apparatus of the invention.

The heater 1 may be a radiant heater for use in a cooking appliance, such as behind a plate of glass-ceramic material. FIG. 2 shows an example of such a heater having a single heating element 2A, of corrugated ribbon form, supported on a base 3 of insulation material, such as microporous thermal and electrical insulation material, in a metal dish 4.

Figure 3:
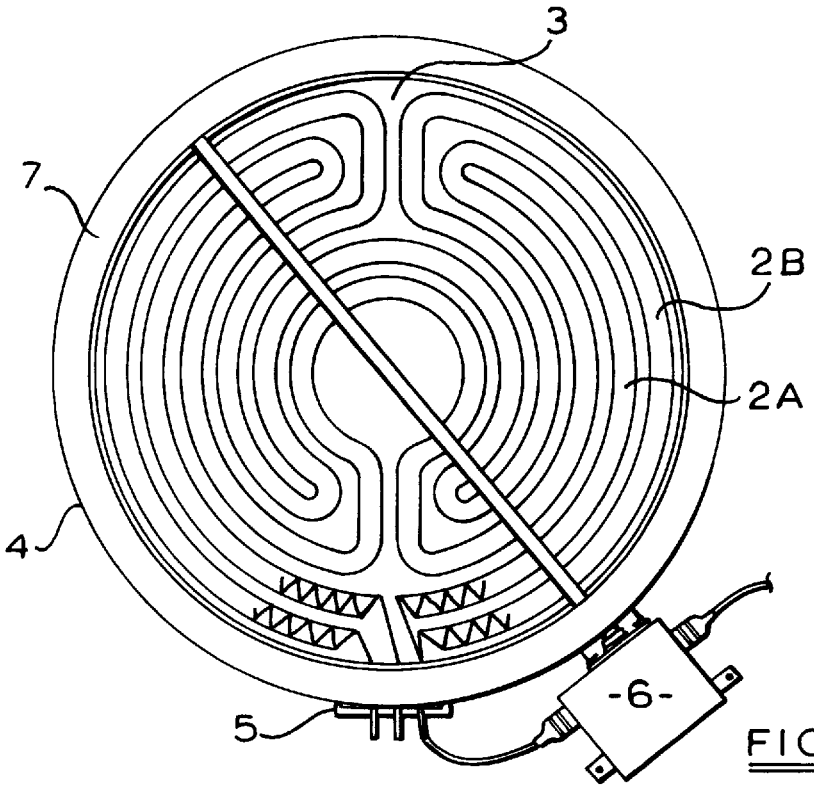
FIG. 3 is a plan view of a heater, having two heating elements, for use with the apparatus of the invention.

In FIG. 3 an example is shown of a radiant heater having two heating elements 2A, 2B, of coiled wire form, supported on a base 3 of insulation material, such as microporous thermal and electrical insulation material, in a metal dish 4.

Figure 4:
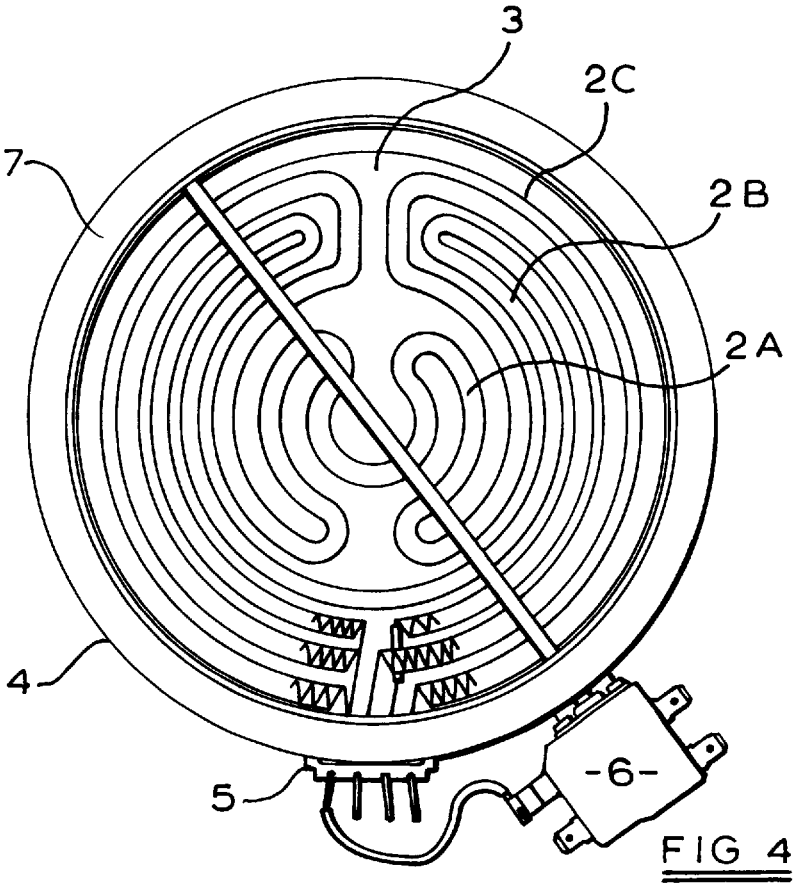
FIG. 4 is a plan view of a heater, having three heating elements, for use with the apparatus of the invention.

In FIG. 4 an example is shown of a radiant heater having three heating elements 2A, 2B, 2C, of coiled wire form, supported on a base 3 of insulation material, such as microporous thermal and electrical insulation material, in a metal dish 4.

In each of the heaters of FIGS. 2, 3 and 4, a terminal block 5 is provided by means of which the heaters may be electrically connected for energisation an d control. A well-known form of temperature limiter 6 is also provided.

A peripheral wall 7 of insulation material is provided, the top of which may contact the rear side of a plate (not shown), such as a glass-ceramic plate.

Referring once more to FIG. 1, the heater 1 is arranged for energisation from a single voltage alternating current supply 8 by way of an isolation switch 9.

A microprocessor-based controller 10, hereinafter referred to as microcontroller 10, is provided having an oscillator 11 connected thereto and provided with an input 12 from the mains supply to ensure synchronisation. A simple form of power supply unit 13 is provided for the microcontroller. The microcontroller is arranged to control the heater 1 in burst fire manner, hereafter described, by way of a solid state switch means such as a triac 14A, in the case of a heater having one heating element 2A. When the heater 1 has two heating elements 2A, 2B, control thereof is arranged by way of two triacs 14A, 14B. In the case of a heater 1 having three heating elements 2A, 2B, 2C, control thereof is arranged by way of three triacs 14A, 14B, 14C.

A manually operable selector arrangement 15 is provided, cooperating with the microcontroller to enable manual selection of any one of a predetermined number of power settings for the heater from the voltage supply. Such manually operable selector arrangement 15 can comprise an analog potentiometer with a suitable control knob, or a suitably encoded digital switch. Such a switch may comprise several contacts moving over a suitably encoded section of a printed circuit track and may be of rotary form. Such a potentiometer or digital switch is also arranged to operate the isolation switch 9, in an 'off' position, to isolate the heater from the mains voltage supply 8 in such 'off' position.

A touch, or other electronic, control system could alternatively be used as the manually operable selector arrangement 15, and cooperating with the microcontroller 10.

The control circuit is adapted and arranged to supply to the heater 1 within a predetermined constant time interval in each power setting a first dissipated power level comprising a first selected proportion of half cycles in a predetermined number of half cycles of the voltage supply and a second dissipated power level comprising a second selected proportion of half cycles in a predetermined number of half cycles of the voltage supply. The second selected proportion is arranged to be different to the first selected proportion in a plurality of power settings. Without consideration of the initial switching on of the heater and the final switching off of the heater it is arranged that there is no more than one change between the first and second dissipated power levels within the predetermined constant time interval.

It may be arranged for the first and second dissipated power levels to be the same only in the maximum power setting for the heater, ignoring in this respect the 'off' setting for the heater.

The predetermined number of half cycles of the voltage supply for the first and second selected proportions of half cycles is arranged to be three and it is arranged for the first and second selected proportions of half cycles in the predetermined number of half cycles to be selected from 0/3, 1/3, 2/3 and 3/3. In this regard it will be understood that 0/3 represents a situation where the heater is not energized and therefore the dissipated power level is zero. 3/3 represents a full power condition in which the supply voltage in full and complete cyclic form is applied to the heater.

As hereinafter demonstrated, the predetermined constant time interval, which is constantly repeating while the heater is turned on, is selected according to the full or rated power of the heater and whether the heater has one, two or three heating elements.

FIG. 5 is a table demonstrating control of a heater 1 having a single heating element 2A with a full or rated power of about 2100 watts, or less, at 230 volts. A control knob is arranged to be manually rotatable through about 360 degrees to effectively provide sixteen power settings varying progressively between a minimum power setting and a maximum power setting. Such manual control is represented by reference numeral 15 in FIG. 1. A predetermined constant time interval of 4 seconds is arranged and the microcontroller 10 (FIG. 1) is programmed to provide, in the first eleven power settings, first dissipated power levels in the heating element 2A of the heater 1 in which one half cycle in three half cycles of the voltage supply is applied for selected proportions of the constant time interval of 4seconds and second power levels in the heating element 2A in which the heating element 2A is not energized (i.e. no half cycles in three half cycles of the voltage supply applied) for the remaining proportions of the constant time interval.

In the twelfth, thirteenth and fourteenth power settings, the microcontroller is programmed to provide first dissipated power levels in the heating element 2A of the heater 1 in which one half cycle in three half cycles of the voltage supply is applied for selected proportions of the constant time interval of 4seconds. Second dissipated power levels are provided in the heating element 2A in which two half cycles in three half cycles of the voltage supply are applied for the remaining proportions of the constant time interval.

In the fifteenth power setting, the microcontroller is programmed to provide a first dissipated power level in the heating element 2A in which two half cycles in three half cycles of the voltage supply are applied for 2.77seconds (i.e. 69.3 percent) of the constant time interval of 4 seconds and three half cycles in three half cycles of the voltage supply are applied for the remaining 1.23seconds (i.e. 30.7 percent) of the constant time interval.

In the sixteenth power setting, which is the full power setting, the microcontroller is programmed to provide first and second dissipated power levels in the heating element 2A which are the same, as a result of applying the voltage supply in full and complete cyclic form (three half cycles in three half cycles) to the heating element for the constant time interval, and indeed continuously.

It will be noted from FIG. 5 that no more than one change occurs between the first and second dissipated power levels within the constant time interval and this, together with the selected value for the constant time interval, results in minimum disturbance to mains power supply networks, particularly with regard to causing flickering of lights connected to the same supply network and meeting the standards specified by the Electro Magnetic Compatibility (E.M.C.) Directive of the European Union.

Furthermore, extremely good performance is achieved in low power settings of the apparatus, whereby excellent simmering performance in cooking operations is achieved.

Referring again to FIG. 5, the second column of the table (headed Power %) shows the dissipated power in the heating element in each power setting as a percentage of the full or rated power and it should be noted that the progressive variation of power settings between the minimum and the maximum follows a geometric progression.

In the third, fourth, fifth and sixth columns in FIG. 5, in addition to the lists of figures given for the times in seconds in which the selected proportions of half cycles in three half cycles are applied in relation to the constant time interval, lists of figures (headed %) are also given which represent the percentages of the constant time interval for which the indicated selected proportions of half cycles in three half cycles of the voltage supply are applied to the heater. Such percentage figures can be used to determine specific times in seconds, in the various selected power settings, for application of the first and second selected proportions of half cycles in three half cycles of the voltage supply when a different constant time interval is adopted, which is necessary with heaters of different full or rated powers or when two or three heating elements are used instead of one.

For heaters having a single heating element with a full or rated power between 1200 watts and 3000 watts at 230 volts, a predetermined constant time interval having a minimum value between 0.3 seconds (1200 watts) and 12 seconds (3000 watts) is suitable. Specific time data can be derived from this, by reference to the percentage of constant time interval data against the various power settings in FIG. 5.

The following table provides indications of minimum values of predetermined constant time intervals for heaters having rated powers at 230 volts between 1200 and 3000 watts and having one, two or three heating elements, the multiple elements being arranged for parallel operation.

| Rated Power of Heater (Watts) | No. of Heating Elements | Minimum Constant Time Interval (Seconds) |
|---|---|---|
| 3000 | 1 | 12 |
| | 2 | 4 |
| | 3 | 1.5 |
| 2400 | 1 | 5.2 |
| | 2 | 1.5 |
| | 3 | 0.5 |
| 2100 | 1 | 3.5 |
| | 2 | 0.8 |
| | 3 | 0.3 |
| 1800 | 1 | 1.9 |
| | 2 | 0.3 |
| | 3 | 0.2 |
| 1500 | 1 | 0.8 |
| | 2 | 0.2 |
| | 3 | 0.2 |
| 1200 | 1 | 0.3 |
| | 2 | 0.2 |
| | 3 | 0.1 |

In the case of a heater having two heating elements 2A, 2B or three heating elements 2A, 2B, 2C, it is preferred for the two heating elements 2A, 2B to have substantially the same electrical resistance values and be arranged for parallel operation and for the three heating elements 2A, 2B, 2C to have substantially the same electrical resistance values and also be arranged for parallel operation. This means, for example, that for a heater having a full or rated power of 2400 watts at 230 volts, and having two heating elements, each element would have a full or rated power of 1200 watts. For a corresponding heater having three heating elements, each element would have a full or rated power of 800 watts.

Figure 6:
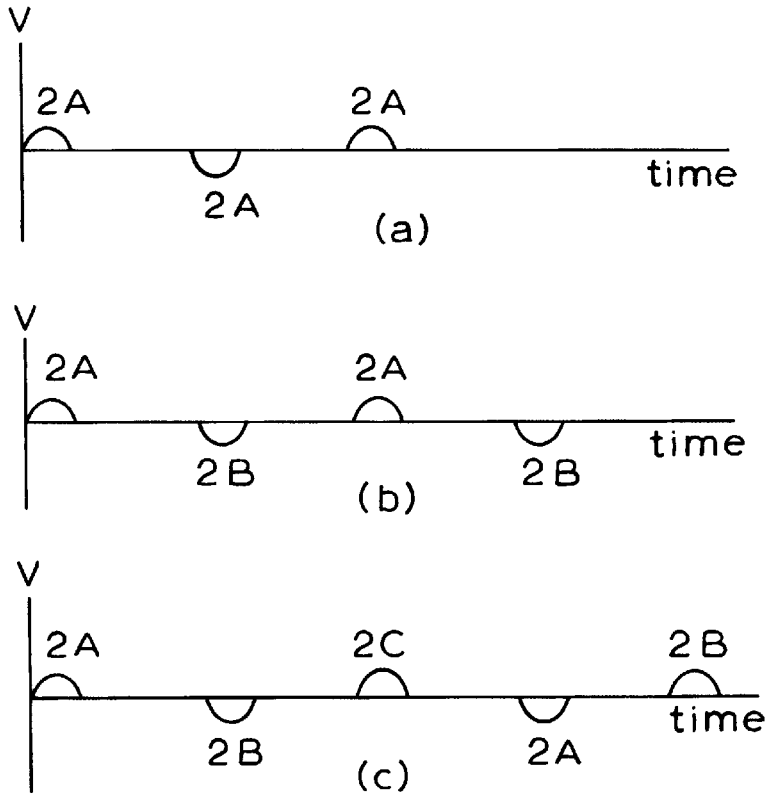
FIG. 6 illustrates application of voltage pulses to a heater having one, two and three heating elements, in control apparatus according to the invention.

For such heaters a preferred technique for control is illustrated in FIG. 6. In FIG. 6, section (a) illustrates a burst firing sequence of one half cycle in three half cycles of the supply voltage applied to a heater having a single heating element 2A, by way of a triac. In this respect, reference should be made to FIG. 1 with regard to heating element 2A and triac 14A.

Also in FIG. 6, section (b) illustrates the burst firing sequence of one half cycle in three half cycles of the supply voltage applied to a heater having two heating elements 2A and 2B, by way of two triacs. In this respect, reference should be made to FIG. 1 with regard to heating elements 2A, 2B and triacs 14A, 14B. As shown in section (b) of FIG. 6, the half cycle bursts are applied sequentially to the heating elements 2A and 2B and because these elements have substantially the same electrical resistance values, substantially no mains disturbance occurs, the effect as far as the control circuitry and mains network are concerned being substantially the same as if a single heating element were being controlled.

Section (c) of FIG. 6 illustrates the burst firing sequence of one half cycle in three half cycles of the supply voltage applied to a heater having three heating elements 2A, 2B and 2C, by way of three triacs. Reference should again be made to FIG. 1 with regard to heating elements 2A, 2B, 2C and triacs 14A, 14B, 14C. As in the case of the heater with two heating elements, the half cycle bursts are applied sequentially to the three heating elements 2A, 2B and 2C and because these elements have substantially the same electrical resistance values, substantially no mains disturbance occurs, the effect as far as the control circuitry and mains network are concerned being substantially the same as if a single heating element were being controlled.

Figure 7:
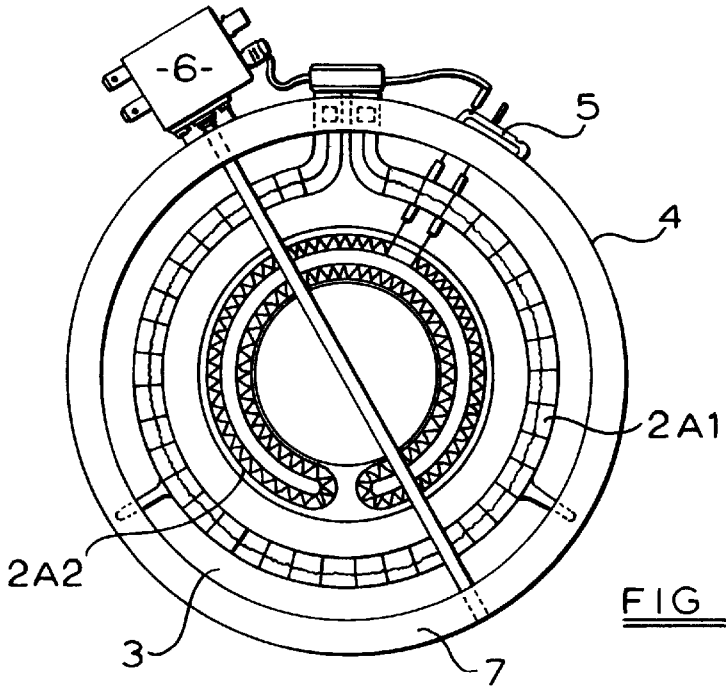
FIG. 7 is a plan view of a heater having a heating element comprising two component elements in series, one of which is a bright radiating component element.

The apparatus of the invention is also applicable where the single heating element 2A of FIG. 1 comprises two component elements 2A1 and 2A2 connected in series as illustrated in FIG. 7. A bright radiating component element 2A1, comprising a tungsten filament inside an envelope, such as of quartz, containing a halogenated atmosphere, is connected in series with a coiled wire resistance element 2A2, such as of iron-chromium-aluminum alloy. The tungsten filament of the bright radiating component element has a large temperature coefficient of resistance of positive sign, such that it exhibits a large change in electrical resistance between room temperature and its operating temperature. The coiled wire component element 2A2, which could be replaced by an element of similar composition but of different form, such as a ribbon element, exhibits a relatively small change in electrical resistance (10percent maximum) between room temperature and its operating temperature. It is connected in series with the bright radiating component element 2A1 to serve as a ballast resistance therefor, in well known manner, to damp inrush current through the component element 2A1 when the heater is switched on. Instead of the bright radiating element 2A1 being of tungsten-halogen form, it could comprise another form, such as an element of molybdenum disilicide.

The remainder of the heater of FIG. 7 is similar to the heaters of FIGS. 2, 3 and 4, with regard to the supporting dish 4, insulation 3, peripheral wall 7, terminal block 5 and temperature limiter 6.

The heater of FIG. 7 is connected to control apparatus and a power supply as shown in FIG. 1, the series combination of component elements 2A1 and 2A2 of FIG. 7 being equivalent to the element 2A in FIG. 1.

The heater of FIG. 7 may be designed to have a full or rated power typically between 1200 watts and 3000 watts, typically at 230 volts. A heater may be designed such that about one half of the rated power is dissipated in the bright radiating component element 2A1, with the remaining power being dissipated in the series-connected component element 2A2. Alternatively a heater may be designed such that about two thirds of the rated power is dissipated in the component element 2A1 and one third in the component element 2A2.

The control apparatus of FIG. 1 operates with the heater of FIG. 7 in similar manner as previously described with reference to the heater of FIG. 2, the predetermined constant time interval and the times for application of the first and second selected proportions of half cycles in a predetermined number of half cycles of the voltage supply being appropriately selected. For a heater rated at 1200 watts and having about one half of this power dissipated in the bright radiating component 2A1, the predetermined constant time interval may have a minimum value of the order of 2.5 seconds, while for a similar heater rated at 3000 watts, the predetermined constant time interval may have a minimum value of the order of 50 seconds. Minimum values for the constant time interval may be readily established pro-rata for heaters rated at powers between 1200 and 3000 watts.

Although these minimum values for the predetermined constant time interval may seem long, particularly for heaters of the higher rated powers, they are in fact about one third of the corresponding minimum switching time intervals possible to meet mains disturbance regulations with the electromechanical energy regulators of the prior art and therefore representing a very real improvement over the prior art regulators.

For a heater of FIG. 7 rated at 1200 watts and having about two thirds of this power dissipated in the bright radiating component element 2A1, the predetermined constant time interval may have a minimum value of the order of 6 seconds, while for a similar heater rated at 3000 watts, the predetermined constant time interval may have a minimum value of the order of 120 seconds. These minimum values are about one quarter of the corresponding minimum switching time intervals possible to meet mains disturbance regulations with the electromechanical energy regulators of the prior art.

I claim:

1. Apparatus for controlling an electric heater incorporating at least one electric heating element and energised from a single voltage alternating current supply, the apparatus comprising:

means for manually selecting any one of a predetermined number of power settings for the heater from the voltage supply, the power settings varying progressively between a minimum power setting and a maximum power setting; and control means adapted and arranged to supply in continuing sequence to the electric heater in a plurality of power settings a first dissipated power level comprising a first non-zero proportion of half cycles in a predetermined first plurality of half cycles of the voltage supply and a second dissipated power level comprising a second non-zero proportion of half cycles in a predetermined number of half cycles of the voltage supply, the second proportion being different to the first proportion and each pair of first and second proportions occupying a predetermined constant time interval, there being no more than one change between the first and second dissipated power levels within the predetermined constant time interval.

2. Apparatus according to claim 1, wherein the predetermined number of half cycles of the voltage supply, for the first and second selected proportions of half cycles, is three.

3. Apparatus according to claim 2, wherein the first and second selected proportions of half cycles in the predetermined number of half cycles is selected from 0/3, 1/3, 2/3 and 3/3.

4. Apparatus according to claim 3, wherein the heater has a full or rated power of 1200 to 3000 watts, the at least one heating element exhibiting a maximum change in electrical resistance of the order of 10 percent between room temperature and operating temperature.

5. Apparatus according to claim 4, wherein the heater has only one heating element, the predetermined constant time interval having a minimum value of 0.3 to 12 seconds.

6. Apparatus according to claim 4, wherein the heater has two heating elements arranged for parallel operation, the predetermined constant time interval having a minimum value of 0.2 to 4 seconds.

7. Apparatus according to claim 6, wherein the two heating elements have substantially the same electrical resistance value, each element having a full or rated power of 600 to 1500 watts.

8. Apparatus according to claim 4, wherein the heater has three heating elements arranged for parallel operation, the predetermined constant time interval having a minimum value of 0.1 to 1.5 seconds.

9. Apparatus according to claim 8, wherein the three heating elements have substantially the same electrical resistance value, each element having a full or rated power of 400 to 1000 watts.

10. Apparatus according to claim 3, wherein the heater has a full or rated power of 1200 to 3000 watts and a heating element comprising a bright radiating component element exhibiting a large change in electrical resistance between room temperature and operating temperature and connected in series with a ballast component element exhibiting a relatively small maximum change in electrical resistance of the order of 10percent between room temperature and operating temperature, and in which about one half of the full or rated power is dissipated in the bright radiating component element, the predetermined constant time interval having a minimum value of 2.5 to 50 seconds.

11. Apparatus according to claim 10, wherein the heating element comprising a bright radiating component element is made of a material selected from tungsten and molybdenum disilicide.

12. Apparatus according to claim 3, wherein the heater has a full or rated power of 1200 to 3000 watts and a heating element comprising a bright radiating component element exhibiting a large change in electrical resistance between room temperature and operating temperature and connected in series with a ballast component element exhibiting a relatively small maximum change in electrical resistance of the order of 10percent between room temperature and operating temperature, and in which about two thirds of the full or rated power is dissipated in the bright radiating component element, the predetermined constant time interval having a minimum value of 6 to 120 seconds.

13. Apparatus according to claim 12, wherein the heating element comprising a bright radiating component element is made of a material selected from tungsten and molybdenum disilicide.

14. Apparatus according to claim 1, wherein the control means comprises at least one microprocessor-based device.

15. Apparatus according to claim 14, wherein the control means supplies power to the heater by operation of at least one solid state switching device.

16. Apparatus according to claim 15, wherein the at least one solid state switching device comprises a triac.

17. Apparatus according to claim 15, wherein the heater incorporates a plurality of heating elements, each heating element being supplied with power by operation of a separate solid state switching device.

18. Apparatus according to claim 1, wherein the means for manually selecting any one of a predetermined number of power settings is selected from an analog potentiometer, an encoded digital switch and a touch control system.

19. Apparatus according to claim 18, wherein the means for manually selecting any one of a predetermined number of power settings is selected from an analog potentiometer and an encoded digital switch, the manually selecting means being of rotary form, operable by a control knob.

20. Apparatus according to claim 1, wherein the progressive variation of power settings between the minimum power setting and the maximum power setting follows a geometric progression.

21. A cooking appliance comprising a heater and apparatus for controlling the heater, the heater incorporating at least one electric heating element and being energized from a single voltage alternating current supply, and the apparatus comprising:

means for manually selecting any one of a predetermined number of power settings for the heater from the voltage supply, the power settings varying progressively between a minimum power setting and a maximum power setting; and control means adapted and arranged to supply in continuing sequence to the electric heater in a plurality of power settings a first dissipated power level comprising a first non-zero proportion of half cycles in a predetermined first plurality of half cycles of the voltage supply and a second dissipated power level comprising a second non-zero proportion of half cycles in a predetermined second plurality of half cycles of the voltage supply, the second proportion being different to the first proportion and each pair of first and second proportions occupying a predetermined constant time interval, there being no more than one change between the first and second dissipated power levels within the predetermined constant time interval.

* * * * *